US005086942A

United States Patent [19]

Merz et al.

[11] Patent Number: 5,086,942

[45] Date of Patent: Feb. 11, 1992

[54] COVER WITH LOCKING DEVICE

[75] Inventors: Johann Merz, Schwäbisch Gmünd; Josef Schmid, Mutlangen; Eckard Keicher, Neuenstadt, all of Fed. Rep. of Germany

[73] Assignee: Zahndradfabrik Friedrichshafen, AG., Friedirchshafen, Fed. Rep. of Germany

[21] Appl. No.: 460,918

[22] PCT Filed: Dec. 17, 1988

[86] PCT No.: PCT/EP88/00852

§ 371 Date: Feb. 20, 1990

§ 102(e) Date: Feb. 20, 1990

[87] PCT Pub. No.: WO89/02857

PCT Pub. Date: Apr. 6, 1989

[30] Foreign Application Priority Data

Sep. 22, 1987 [DE] Fed. Rep. of Germany ..... 3731798

[51] Int. Cl.[5] ..... B65D 41/06

[52] U.S. Cl. ..... 220/302; 220/293

[58] Field of Search ..... 220/293, 298, 301, 302, 220/DIG. 32, DIG. 33; 215/294

[56] References Cited

U.S. PATENT DOCUMENTS

| | | | |
|---|---|---|---|
| 1,759,243 | 3/1930 | Reid | 220/302 |
| 1,759,244 | 3/1930 | Reid | 220/302 |
| 1,762,852 | 6/1930 | Zarobsky | 220/302 |
| 1,806,224 | 5/1931 | Stant | 220/301 X |
| 1,838,639 | 9/1939 | Reid | 220/302 |
| 2,531,860 | 11/1950 | O'Neil, Jr. | 220/302 |
| 4,300,702 | 11/1981 | Scharrer | 220/295 |
| 4,497,419 | 2/1985 | Reitzel | 220/302 |

FOREIGN PATENT DOCUMENTS

| | | |
|---|---|---|
| 1505606 | 8/1970 | Fed. Rep. of Germany . |
| 2917149 | 3/1980 | Fed. Rep. of Germany . |
| 3540502 | 3/1987 | Fed. Rep. of Germany . |

*Primary Examiner*—Stephen Marcus
*Assistant Examiner*—Stephen Cronin
*Attorney, Agent, or Firm*—Albert M. Zalkind

[57] ABSTRACT

A cover, especially for an oil tank, has a locking device with flexible arm carrying locking elements flexibly slidable against a bayonet curved track ridge of a tank opening or tank neck for closure of the tank. The locking device cover is capable of being rotated to close the tank opening without manual downward pressure. A bayonet curved track ridge has spring pressure of the flexible arms eliminating need for manual pressure. The construction is a single integral member made from a plate of spring steel, or made from plastic, of suitable flexibility. It has a bed plate with prongs formed from the edges of an aperture through the bed plate for gripping a pin carried by the cover to secure the locking device to the cover. The flexible arms extend in curved contour from the bed plate and have outer free ends on which the locking elements are located which slidably engage the bayonet track ridge in the tank opening or neck for limited rotation up to a stop for locking the cover to a tank.

9 Claims, 1 Drawing Sheet

COVER WITH LOCKING DEVICE

The invention comprises a locking device for a tank opening cover, especially for an oil tank, in which the locking device elements work together with a bayonet curved track ridge in the tank opening, e.g., the neck, and wherein the invention can be secured in the tank under spring prestress in coaction with the bayonet track.

BACKGROUND OF THE INVENTION

Covers of this kind which give a quick closure by means of a bayonet joint, are known for numerous applications, for example, for oil tanks, the cooling water containers of a motor vehicle and the like. Cover locking devices are carried inside the cover designed for specific tanks. By a slight rotation of the cover, usually assisted by a suitable downward pressure, the locking elements of such devices are guided by a curved bayonet track ridge internally of the tank neck and generally stopped from rotation after a quarter turn.

A spring tension arrangement provides for a prestressing of the locking elements and a reliable guiding and a clamping of the cover to the tank. A sealing, with a ventilating drilled hole, if applicable, can be obtained by means of an additional seal.

Known covers consist of several parts, specifically, the actual cover, the inner part with the locking elements and a spring means, generally a spiral spring, for producing the desired prestress. Furthermore, the cover usually also has a member to be inserted as an outer support for the spiral spring.

Since the sheet metal part in the known constructions constitutes a rigid element with the locking elements, the spring had the task of bringing about a tolerance adjustment along with the prestressing and sealing of the cover.

SUMMARY OF THE INVENTION

The object of the present invention is to produce a cover of the type mentioned above that is simple and inexpensive to manufacture, viz., one that is especially suitable for mass production and closes securely.

That object is accomplished in the invention by using a bed plate having fastening members to fasten it to the cover, and having flexible arms wherein outer free ends have locking elements extending outwardly of the bed plate.

As a result of this arrangement, the cover is simpler and hence cheaper to manufacture because of its novel locking device. Practically speaking, the invention consists only of a single element, specifically, a bed plate from which fastening members to the cover and flexible locking elements are integrally formed together with flexible arms. This single integral unit replaces prior art constructions. A spring action and also a tolerance adjustment during the closing of the cover, that is, during the guiding of the locking elements of the curved bayonet track ridge of the cover are obtained by the arms projecting from the bed plate, which act like a centering support in the collar. A simple embodiment of the invention can consist of having curved flexible arms and projecting freely flexibly from the bed plate.

In the invention, two flexible arms are located opposite each other diametrically.

The shape of the curve of the arms and their free ends is made to fit the inner wall or neck of the tank, so that the locking elements can be guided suitably on the bayonet curved track ridges.

Although fastening of a lock device to a cover itself can be accomplished in any desired way, the invention utilizes a simple but very effective fastening of the locking device to the cover wherein the bed plate has a center aperture into which a projection such as a tongue or pin carried by the cover enters the aperture to be clamped to the bed plate. The edges of the apertures have upstanding lugs or prongs that fit tightly around the cover pin. Such prongs can fit in recesses of the pin or into undercuts.

Prongs can be bent out of the plane of the bed plate at a slight slant so that the top edges grip against the circumferential wall of the cover pin, a simple unitary assembly and, above all, a unit that is capable of being assembled quickly.

To obtain a precisely defined position for the start of the cover rotation, the cover is keyed to the pin. Thus, the cover pin has a quadrilateral cross section and the bed plate has a matching shaped quadrilateral aperture.

Of course, any cross section of the pin and a matching contour of the aperture shaped to prevent relative rotation is usable.

The locking device can be manufactured simply and cheaply if the bed plate, with the fastening members, the arms and the locking elements, are all punched and shaped from a plate of spring steel.

The locking device can thus be made practically in one procedure in which it is only necessary to form parts not in the plane of the bed plate by bending, such as the locking elements.

Instead of spring steel, a plastic can likewise can be substituted within the scope of the invention, and when that is done it is only necessary for the plastic to have suitably flexible or elastic characteristics, viz, suitable for single integral piece manufacture as will be understood by persons skilled in the art.

The locking elements, together with the arms, work practically like a plate spring that is fixed at one end, and the elements that project from the bed plate and carry lock means are designed for stability and balancing of the forces which they exert.

A detailed description of the invention now follows in conjunction with the appended drawing in which.

Figure 1:
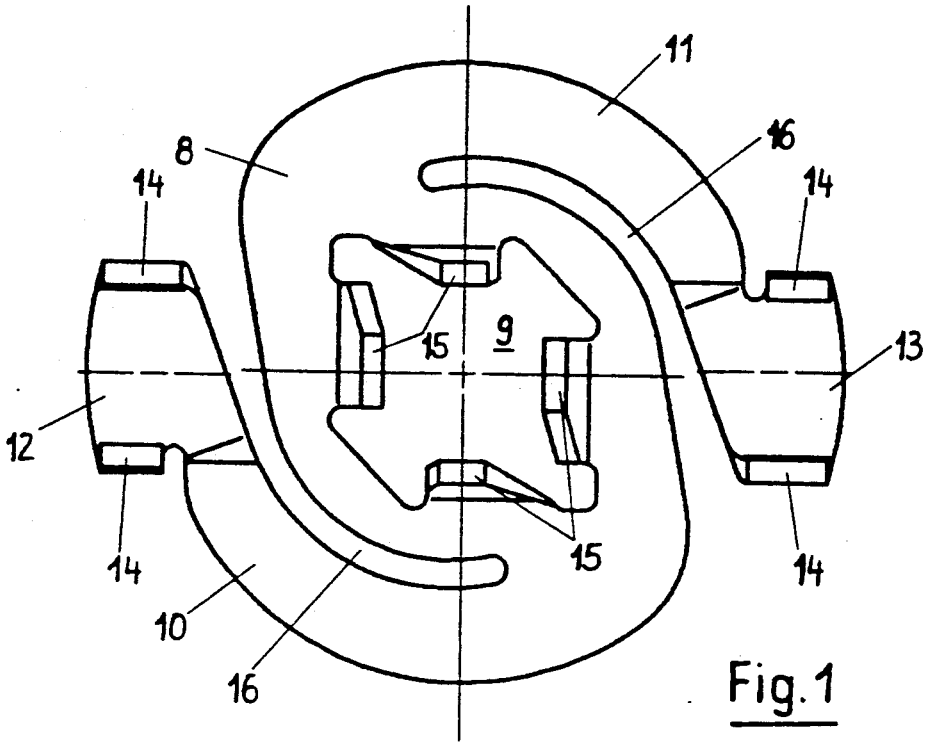
FIG. 1 shows a plan view of the locking device of the invention.

A cover 1 with a hasp rim 2 has a central pin 3 in its central area that has a quadrilateral shape in cross section and is slightly conical at least in the area of its free end. The cover is provided with a gasket 4 for sealing that is pressed onto the neck of a tank 5. The tank 5 (FIG. 3) has a bayonet curved ridge extending into it with the lower surface inclined, as known in the art, the inclined ends briefly flat at the downmost end 7 with a stop that limits rotational travel of the cover. This provides a positive degree of rotation up to the stop.

Figure 2:
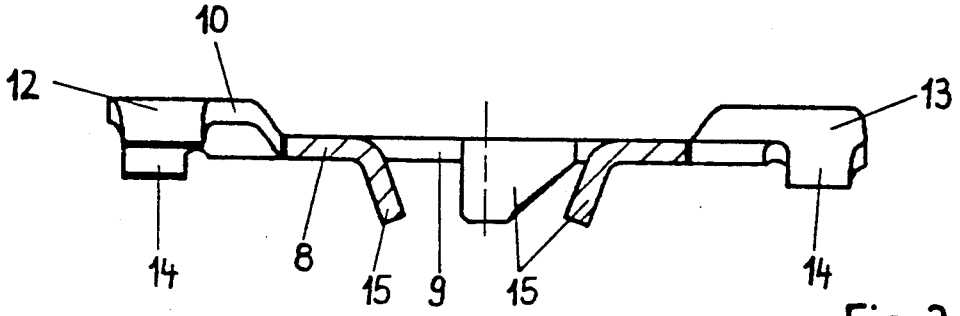
FIG. 2 is an elevation partially in section of the locking device of FIG. 1.

As seen in FIGS. 1 and 2 the invention comprises a bed plate 8 to be carried inside the cover, with a central aperture 9 inner area. Two curved flexible arms 10 and 11 are located diametrically opposite each other integral with the bed plate.

They carry at their free ends bent formations 12 and 13 which are the locking members and comprise the locking elements 14 each having perpendicularly integral parallel stiffening flanges from the locking members 12 and 13 as shown.

The locking elements are suitably shaped to slide resiliently against the bayonet track ridge 6 in the cover.

Figure 3:
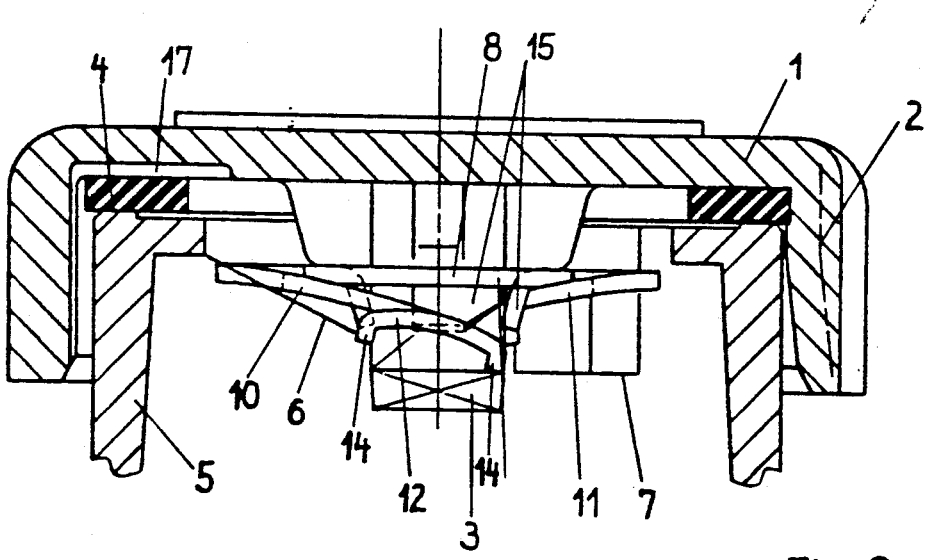
FIG. 3 shows a section longitudinally of the locking device in place on the neck of a tank.

From the edges of the aperture 9, four flexible prongs 15 are outwardly formed at an inward slant spaced uniformly around the aperture, to flexibly grip tapered pin 3, as illustrated in FIG. 3.

As will be understood, the invention is integrally formed from a plate of spring steel as by a punching process. Thus, prongs 15 and the locking elements 14 are bent as shown out of the flat plate surface from which the opening 9 and slots 16 for separating the arms 10 and 11 from the bed plate are punched out.

The locking device after being formed can be assembled easily with the cover 1. For that purpose, it is only necessary to push the bed plate 8 so that aperture 9 fits snugly around the pin 3.

If the bed plate consists of a material harder than the pin 3, which may constitute preferably a single piece with the cover 1, the prongs 15 have sufficient flexibility whereby the slanted sides have flexing that can grip the cover pin 3 for clamping to it. Thus, a reliable joint is guaranteed.

In order to prevent rotational slippage between the pin 3 and bed plate 8 a keying can be used. For example, by squaring the cross section of the pin to fit onto a similarily squared aperture 9, as shown, or using any matching piece that has a keying effect.

To close a tank, the cover 1 is placed on the neck of the tank 5, with the locking elements 14 being inserted in the bayonet curved track ridge 6 of the neck. When the cover 1 is twisted slightly, the locking takes place. No manual pressure is needed and no special spring is required because of the material of which the invention is made and the flexibility of the two arms 10 and 11 and their construction like plate springs. A ventilating slot 17 can be provided in the cover 1 as shown to ventilate the tank.

We claim:

1. A cover (1) and locking device for a tank (5) opening, said locking device comprising a bed plate (8) having an aperture (9) for receiving a cover pin (3) carried by the cover for securement of the locking device to the cover; said bed plate carrying diametrically opposed locking elements (14) for coaction with a bayonet track ridge inside the tank;

the improvement wherein:

said bed plate has flexible curved arms (10, 11) carrying said locking elements (14) and said flexible arms extending from said bed plate (8); said bed plate having said aperture (9) and flexible prongs (15) extending outward from the edge of said aperture for gripping said cover pin to secure said locking device to said cover, wherein said bed plate, flexible arms, and flexible prongs are formed integrally of a spring material.

2. A cover and locking device as set forth in claim 1, said prongs having an arrangement wherein said aperture has a contour to lock said bed plate non-rotatably to said cover with said cover pin protruding through said aperture in said bed plate.

3. A cover and locking device as set forth in claim 2, wherein said cover pin is tapered towards its outer end.

4. A cover and locking device as set forth in claim 1, wherein said base plate, flexible arms, flexible prongs, and locking elements are integrally formed of an elastic synthetic material.

5. A cover as set forth in claim 1, wherein said bed plate, flexible arms, flexible prongs, and locking elements are formed integrally of spring steel.

6. A cover and locking device as set forth in claim 1, wherein said locking elements have flanges extending perpendicularly from the plant of said flexible arms.

7. A locking device for the cover of a tank opening made integrally from a plate of spring steel comprising:

a bed plate (8) having flexible arms (10, 11) extending therefrom, said arms carrying locking elements (14) capable to coact with a bayonet track ridge of a tank; wherein said bed plate has a centrally located aperture (9), fastening prongs (15) extending outwardly from edges of said aperture for fastening said locking device to a cover pin which forms an integral part of a cover.

8. Inner part for a cover, especially for an oil tank, said inner part having locking elements capable to work together with a bayonet curved track of a tank to be closed, said inner part comprising:

a bed plate (8) with fastening members (15) forming part of the bed plate, for fastening to the cover, curved flexible arms (10, 11) extending from said bed plate and locking elements (14) at the end of the flexible arms.

9. Inner part for a cover as set forth in claim 8, wherein the locking members take the form of bent formations (12, 13) acting as stiffening flanges.

* * * * *